United States Patent [19]

Kendall et al.

[11] Patent Number: 5,058,585

[45] Date of Patent: Oct. 22, 1991

[54] ORTHOTIC SHOE INSERT

[75] Inventors: Michael Kendall, 4325 Cleveland Ave., San Diego, Calif. 92103; Thomas L. Chadbourne, San Diego, Calif.

[73] Assignee: Michael Kendall, San Diego, Calif.

[21] Appl. No.: 471,860

[22] Filed: Jan. 29, 1990

[51] Int. Cl.[5] ..... A61F 5/14

[52] U.S. Cl. ..... 128/581

[58] Field of Search ..... 128/596, 595, 586, 581; 36/43, 44

[56] References Cited

U.S. PATENT DOCUMENTS

| | | | |
|---|---|---|---|
| 3,757,435 | 9/1973 | Schwartz | 36/44 |
| 4,188,736 | 2/1980 | Keller | 36/43 |
| 4,360,027 | 11/1982 | Friedlander et al. | 128/581 |
| 4,747,410 | 5/1988 | Cohen | 128/581 |

*Primary Examiner*—Richard J. Apley
*Assistant Examiner*—L. Thomas
*Attorney, Agent, or Firm*—Dinah Newton Hill

[57] ABSTRACT

An orthotic shoe insert adapted to effectively control foot motion during gait to reduce trauma to various anatomical structures of the lower extremity and to increase gait efficiency. The orthosis comprises a unitary, curved wedge having a hook-like shape when viewed from above and includes a heel portion adapted to engage the sides of the heel, a middle portion adapted to engage the plantar side of the medial portion of the longitudinal arch, and a front portion adapted to engage the plantar side of the user's forefoot to a level just distal to the first and second metatarsal heads. The orthosis adjusts itself to different arch heights, and therefore may be fabricated without requiring custom fitting.

13 Claims, 2 Drawing Sheets

FIG. 1
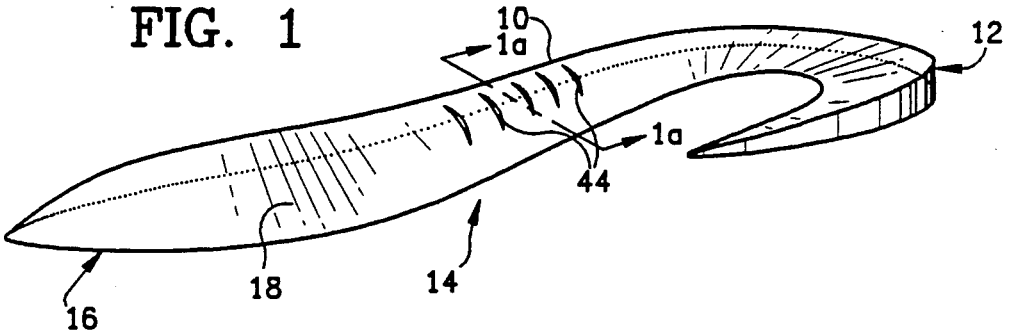
FIG. 1a
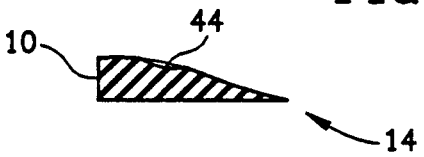
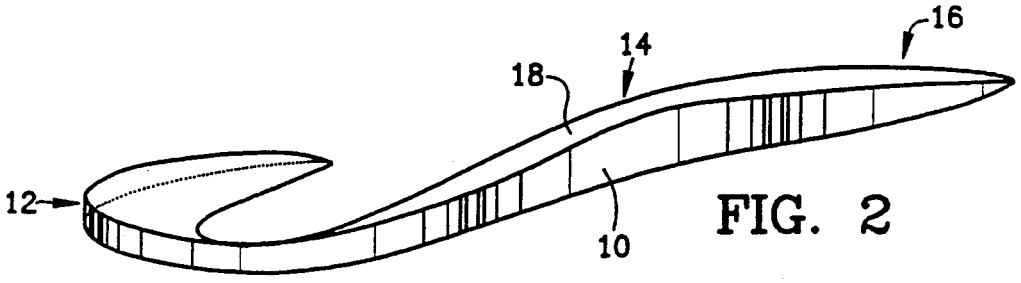
FIG. 2
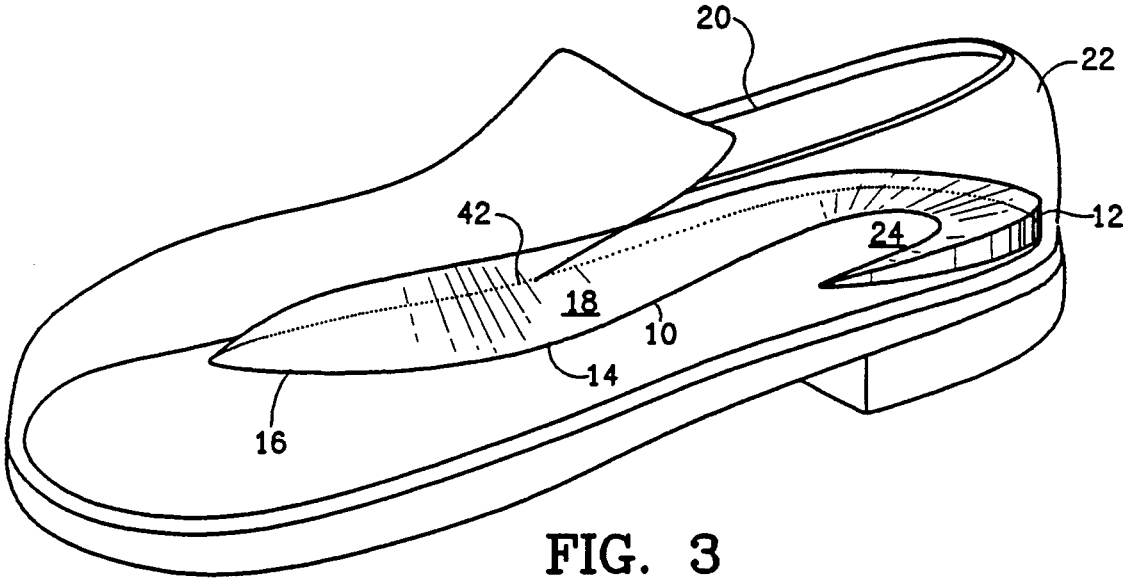
FIG. 3

ORTHOTIC SHOE INSERT

BACKGROUND OF THE INVENTION

1. Field of the Invention

The present invention relates generally to shoe inserts, and more particularly to podiatric orthotic devices ("orthoses") designed to provide functional control of lower extremity motion during gait.

2. Related Art

The surfaces of a typical shoe insole which support the heel and ball of the foot, which are the principal weightbearing areas of the foot, are approximately planar. Over the past several decades, research has disclosed that use of shoe inserts to modify the shape and resilience of these surfaces can provide many benefits. These benefits fall principally into two categories: stress accommodation and functional control. Inserts designed primarily to provide stress accommodation are called accommodative orthotic devices. Inserts designed primarily to provide functional control of lower extremity motion during gait are called functional orthotic devices.

An accommodative orthotic device is designed to distribute the stresses of weightbearing to areas of the foot which can best tolerate such stresses, in order to maximize comfort and minimize trauma to the sole of the foot. Such an orthosis provides a padded surface which may be flat, or which may be shaped to conform with the contours of a particular foot (a custom molded orthosis) or an average foot (a non-custom orthosis). Non-custom accommodative orthoses tend to be either significantly flatter than the average sole, or to be fabricated from a soft material which compresses under loads of less than about 5% of body weight so as to be tolerated across a population possessing wide variations in sole contour. Such devices may increase foot comfort, but are unlikely to provide significant control of foot motion.

A functional orthosis, on the other hand, is designed to guide and restrict the motion of joints of the foot in order to improve gait efficiency and to reduce the stresses imposed on lower extremity anatomical structures during gait. As a rule, functional orthoses are fabricated of firmer materials than are accommodative devices. The main goal of a functional orthosis is to resist pronation, a complex foot motion which produces the partial collapse of the medial longitudinal arch of the foot, best seen during the midstance phase of the gait cycle. Pronation actually consists of the abduction, eversion, and dorsiflexion of the forefoot in relation to the rearfoot. Because of the shapes and close contiguity of the joints involved, pronation is always accompanied by eversion of the heel and internal rotation of the leg and hip.

While pronation is a normal part of gait, it is now well established that excessive pronation is the source of many lower extremity pathologies, including muscle tiredness and inflammation, foot and knee joint pain, tendinitis, ligament strain, and even neurological damage. Excessive pronation also renders the gait less efficient since time and effort is wasted in collapsing (pronating) and recovering (supinating). It has been estimated that up to 70% of the population overpronates to some degree. Control of pronation is accomplished by a functional orthosis primarily by providing firm support for the foot's medial arch, secondarily by reducing heel eversion, and in some cases also by inverting the forefoot relative to the rearfoot.

Peak forces transmitted through the feet during running can easily exceed three times body weight. In order to resist such forces, a functional orthosis must be fabricated of a firm material. To remain comfortable and to avoid painful high pressure spots, it must also conform closely to the contours of the sole of the foot in its neutral position. Proper arch height is particularly critical in a functional orthosis. If the arch is too high, the device will be intolerably painful. On the other hand, if the arch is too low, control of pronation will be sacrificed. Significantly, due to the high forces transmitted through feet during gait, small variations in the form and material of orthoses can produce profound differences in orthosis function and comfort.

To satisfy the dual requirements of firm support and precisely contoured fit, prior art functional orthoses have generally been produced from a custom mold of an individual foot. In addition to the disadvantages of the tedium and expense of the custom-molding procedure, such prescription devices frequently require modifications subsequent to fitting.

With the exception of devices which employ an arch support consisting of a fluid-containing bladder, orthoses previously available which do not require a mold of the foot for their fabrication must be classified as accommodative, not functional devices. While such accommodative devices may increase foot comfort, they cannot reliably provide significant functional control since they are not typically made of sufficiently firm material and they do not conform equally well to the soles of different feet. A device sold without custom fitting is likely to have an arch which is too low to provide significant control of pronation.

Unfortunately, currently available functional orthoses are plagued by several additional shortcomings. First, these devices are typically bulky. To accommodate the orthosis, a shoe's insole, if present, must typically be removed or the shoe must be replaced with another of larger size. In either case, the fit of the shoe is altered. Moreover, insertion of such a device into the shoe raises the center of gravity of the foot within the shoe, thereby destablizing the foot. By changing the fit of the shoe, these devices frequently counteract its supportive design features.

Another disadvantage shared by currently available functional orthoses is that they are typically fabricated of rigid materials, e.g., hard plastics. Prolonged wear of such rigid devices causes degradation of the foot's plantar fat pad, leading to the formation of painful calluses.

Since the adverse effects of excessive pronation are suffered by a large percentage of the population, it would be highly desirable to have an orthotic shoe insert which could be readily accommodated in all types of footwear, which did not require custom fitting, and which provided effective functional control of pronation.

SUMMARY OF THE INVENTION

The present invention comprises a functional orthotic shoe insert adapted to be placed into an athletic or street shoe and to act as an integral part of the shoe. The inventive orthosis functions to properly align and support the foot so as to reduce pronation during gait, thereby reducing trauma to anatomical structures of the lower extremity and increasing efficiency of gait. The orthosis is designed to self-adjust to different arch heights and sole contours, obviating the tedious and expensive custom-fitting heretofore required to fabricate orthoses which provided true functional control of the foot.

The orthosis of the present invention comprises a unitary, curved wedge having a hook-like shape when viewed from above. The device includes a heel portion adapted to engage the sides of the heel and to allow the plantar side of the heel to rest on the shoe's insole or inside, a middle portion adapted to engage the plantar side of the medial portion of the longitudinal arch, and a front portion adapted to engage the medial aspect of the ball of the foot, to a level just distal to the first and second metatarsal heads.

The inventive orthosis accomplishes control of pronation in the following ways:

(1) the heel portion reduces eversion of the heel, an integral part of pronation, by extending the weight bearing surface of the heel up onto the heel margins and providing a semicircular buttress against rolling of the heel within the shoe;

(2) the middle portion functions as an arch support, reducing pronation by blocking plantar-directed motion along the medial aspect of the foot; and (3) the front portion elevates the heads of the first and second metatarsals and places the forefoot in an approximately 0° to 2° inverted attitude. This slight varus correction acts to reduce pronation by maintaining the forefoot in an inverted position throughout the midstance and propulsive phases of gait. It also compensates for three common foot conditions: hallux limitus, metatarsus primus elevatus, and Morton's toe.

The orthosis is designed to work in concert with a shoe's insole where present. Specifically, the orthotic is incorporated into a shoe by removing the shoe's insole if present, inserting the orthotic, and replacing the insole to be positioned flush with the orthotic. In a preferred embodiment of the invention, the orthotic is provided with an indentation which extends along its inner edge and into which the insole may be seated. Smooth continuous support of the foot is thereby provided.

Since the orthosis allows the majority of the foot to rest against the insole or inside of the shoe, it does not raise the center of gravity of the foot. The design of the shoe is therefore not compromised.

The orthosis is preferably made of polyurethane. However, any closed cell foam having a high compression rate may be substituted.

Further advantages and features of the invention will become apparent from the following detailed description.

DESCRIPTION OF THE DRAWINGS

FIG. 1 is a perspective view of an embodiment of an orthotic shoe insert according to the present invention designed for the left foot.

FIG. 1*a* shows a sectional view of the invention taken along lines 1*a*—1*a* of FIG. 1.

FIG. 2 is another perspective view of the embodiment shown in FIG. 1.

FIG. 3 is a perspective view of an orthotic shoe insert according to the present invention positioned in a left shoe.

Like reference characters in the various drawings refer to like elements.

DETAILED DESCRIPTION OF THE INVENTION

Figure 4:
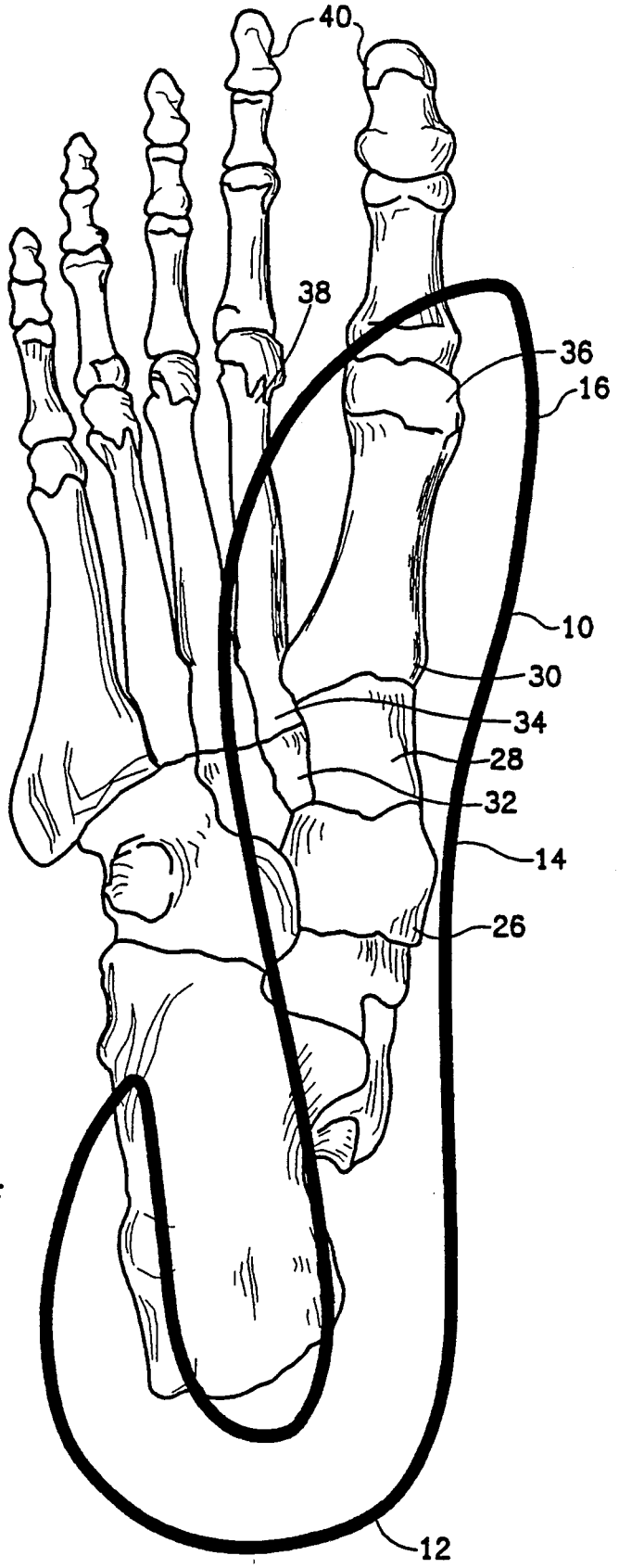
FIG. 4 is a bottom view of an orthotic shoe insert according to the present invention engaging the plantar side of a human foot, the foot being illustrated only with respect to its bones.

The following description is of the best presently contemplated mode of carrying out the invention. This description is made for the purpose of illustrating the general principles of the invention and should not be taken in a limiting sense. The scope of the invention is best determined by reference to the appended claims.

FIGS. 1 and 2 show perspective views of the preferred embodiment of an orthotic shoe insert 10 according to the present invention. The insert 10 includes a substantially U-shaped, wedged heel portion 12, a wedged middle portion 14 and a front portion 16. Each portion of the device includes a top surface 18 for engaging the foot of a user.

The orthotic shoe insert 10 is preferably constructed of closed cell polyurethane and polyurethane elastomers. However, other closed cell foams having high compression rates may be substituted.

As is illustrated in FIG. 3, when the insert 10 is positioned in a shoe 20, the insert heel portion 12 fits within the heel portion 22 of the shoe 20. The top surface 18 of the insert heel portion 12 is adapted to engage the medial, posterior, and lateral portions of the heel. The shape of the heel portion 12 forms an aperture 24 for the central and anterior plantar portions of the heel. The aperture 24 minimizes the space which the device occupies in the shoe and permits expansion to accommodate different heel widths.

The insert heel portion 12 is wedge-shaped in cross section, tapering from the portions supporting the outer margins of the heel towards the heel center. The wedge comprising the medial aspect 23 of this portion of the device rises higher than the lateral portion 25, in order to hold the heel in an approximately 2° to 5° inverted position. This design minimizes the heel eversion component of pronation.

The heel portion 12 continues into the middle portion 14. The middle portion 14 is also shaped as a wedge in cross section, tapering medially to laterally in a continuation of the medial side of the heel portion 12. The top surface 18 of the middle portion is shaped concave medially and preferably slightly convex laterally. The middle portion 14 is thickest at its longitudinal center, corresponding to the most elevated portion of the foot's medial longitudinal arch, and tapers proximally and distally. At its peak, this portion of the device ranges from approximately 11 to 19 mm in thickness, depending on the overall size of the device (e.g., an orthosis designed to fit a size 11 man's foot has a peak thickness of approximately 17 mm). When inserted into a shoe, the middle portion 14 extends below a user's foot to approximately one third to one half the width of the foot.

The function of the middle portion 14 will be better understood with reference to FIG. 4. FIG. 4 illustrates some of the bones of the foot supported by the orthotic device 10. The middle portion 14 functions to support the medial portion of the longitudinal arch of the foot by supporting the navicular bone 26, as well as at least the medial cuneiform bone 28 and the shaft of the first metatarsal 30 (thereby blocking plantarflexion of the talus on the navicular bone 26). However, the width of the middle portion 14 may be extended slightly to also extend below the intermediate cuneiform 32 and the shaft of the second metatarsal 34 as shown in FIG. 4.

The middle portion is designed to self-adjust to different arch heights, so as to provide good functional control while remaining comfortable. This self-adjusting action is created by its medial-longitudinal concavity (which straightens with medial displacement), its narrowness, and the pliant nature of the material from which the device 10 is fabricated. These design features permit the present orthosis 10 to maintain a higher arch than other noncustom fitted orthotic devices.

The middle portion 14 acts akin to a pressure valve by tolerating pressure up to a level consistent with functional control, but displacing under pressures which would create arch discomfort. Specifically, the middle portion 14 displaces up to two centimeters medially under the high pressure generated by a low arched foot, yet remains undisplaced under the comparatively light pressures generated by a high arch.

The middle portion 14 extends into the front portion 16 toward the distal portion of the foot (i.e., toward the toes). The front portion 16 comprises a cross-sectional and longitudinal wedge which tapers medially to laterally and proximally to distally. The front portion 16 is substantially thinner and wider (from its medial to lateral edge) than the middle portion 14. This portion is designed to extend below the user's forefoot to the level of the first and second metatarsal heads, 36 and 38, respectively, to provide slight elevation of these joints. The slight elevation of the first and second metatarsal heads 36, 38 places the forefoot in a slightly inverted, approximately 0° to 2° varus attitude. Placement of the forefoot in this orientation increases control of pronation and at least partially compensates for three common foot pathologies: hallux limitus (inadequate range of dorsiflexion of the hallux/big toe), metatarsus primus elevatus (elevated first metatarsal head), and Morton's toe (short first metatarsal).

Hallux limitus produces pain in the joints of the hallux and inhibits the ability of the foot to "push off" during the propulsive phase of the gait cycle. By elevating the head of the first metatarsal, the present invention compensates for the limited range of dorsiflexion by allowing the hallux to rest in a more plantarflexed attitude throughout the propulsion phase of gait. Metatarsus primus elevatus and Morton's toe both increase pronation by preventing the first metatarsal head 36 from adequately retarding the medial roll of the foot. These two conditions increase the weight borne by the second metatarsal 32/38, and can cause callus production under the second metatarsal head 38, or in some cases even stress fracture of the bone. Elevating the first metatarsal head 36 compensates for these conditions. Orthoses which terminate proximal to the metatarsal heads, or which extend the full length of the foot, do not provide like compensation.

While the front portion 16 of the orthosis 10 extends beneath the user's forefoot to at least the level of the first and second metatarsal heads 36, 38, and preferably terminates proximal to the level of the distal phalanges 40 of the hallux and second toe, its precise point of termination within that range is not critical. However, termination of the orthosis short of the full length of the foot allows for the longitudinal extension of the device under high arch pressure.

In one embodiment of the invention depicted in FIG. 3, the top surface 18 of the insert 10 is provided with a horizontal indentation 42 extending along its length. This embodiment is especially adapted for use with shoes having an insole. To use this embodiment, the insole is removed prior to insertion of the insert 10. The insert 10 is then positioned in the shoe and the insole is returned to the shoe. The indentation 42 is positioned on the top surface 18 to allow the edge of the insole to seat therein. The comfort of the shoe generally provided by its insole is thus preserved and together the insole and insert 10 provide smooth, continuous support of the foot.

In another embodiment of the present invention, the top surface 18 of the middle portion 14 is provided with wedge-shaped cuts 44 which extend from its lateral aspect towards its center (see FIG. 1*a*). The cuts 44, approximately 1 to 2 mm deep, further contribute to the self-adjusting action of the middle portion 14 by absorbing pressure upon medial displacement by the user's arch (i.e., the cuts close as the middle portion 14 is compressed).

The orthotic device of the present invention works synergistically with the design of the shoe to provide proper orientation of the foot throughout the gait cycle. By permitting the majority of the plantar side of the foot to rest against the inside of the shoe, the orthosis does not substantially raise the center of gravity of the foot within the footwear and therefore does not destabilize the foot. Additionally, this design permits the orthosis to be easily accommodated by most footwear. The orthosis of the present invention will even fit most women's high heel shoes, unlike most presently available orthotic devices.

The inventive orthotic shoe insert 10 corrects for overpronation which, left uncorrected, may lead to painful foot, knee and hip problems. The insert need not be custom-fitted since the material from which it is made conforms to the user's foot during wear. Thus the insert may be manufactured in only a few sizes corresponding generally to shoe sizes. The orthosis provides support and cushioning where needed and therefore benefits even those users who do not suffer from excessive pronation or the foot pathologies described above.

One preferred embodiment of the present invention has been illustrated and described. Nevertheless, it will be understood that various modifications may be made without departing from the spirit and scope of the invention. Accordingly, it is to be understood that the invention is not to be limited by the specific illustrated embodiment, but only by the scope of the appended claims.

We claim:

1. A curved, unitary functional orthotic device, comprising:

(a) a substantially U-shaped, wedged heel portion adapted to engage the sides of a user's heel while allowing the plantar side of the heel to rest on the inside of a shoe into which the orthotic device is inserted;

(b) a wedged middle portion connecting to the heel portion and adapted to engage the plantar side of the medial portion of the user's longitudinal arch; and (c) a front portion connecting to the middle portion and adapted to engage the plantar side of the user's forefoot to a level just distal to the first and second metatarsal heads;

wherein each portion consists essentially of self-adjusting material to provide functional control of the user's foot and wherein each portion includes a top surface for engaging the user's foot.

2. The orthotic device of claim 1, wherein the wedge of the heel portion holds the user's heel in an approximately 2° to 5° inverted position to minimize the heel eversion component of pronation.

3. The orthotic device of claim 1, wherein the top surface of the middle portion is shaped concave medially.

4. The orthotic device of claim 2, wherein the middle portion has a peak thickness at its longitudinal center, corresponding to the most elevated portion of the user's foot's medial longitudinal arch, and tapers proximally and distally.

5. The orthotic device of claim 4, wherein the peak thickness of the middle portion ranges from approximately 11 to approximately 19 mm.

6. The orthotic device of claim 3, wherein the middle portion extends below the user's foot to approximately one third to one half the width of the foot when inserted into a shoe.

7. The orthotic shoe insert of claim 1, wherein the top surface of the middle portion has a width sufficient to extend below the navicular bone and at least the first cuneiform bone of the user's foot.

8. The orthotic device of claim 1, wherein the front portion is thinner and wider than the middle portion and wherein the top surface of the front portion has a width sufficient to extend below and slightly elevate the first and second metatarsal heads of the user's foot to place the user's forefoot in a slightly inverted, approximately 0° to approximately 2° varus attitude.

9. The orthotic device of claim 1, wherein the top surface of the middle portion is provided with wedge-shaped cuts extending from the lateral aspect of the middle portion towards its center.

10. The orthotic device of claim 9, wherein the cuts are approximately 1 mm to approximately 2 mm deep.

11. The orthotic shoe insert of claim 1, wherein the medial portion of the top surface is provided with a horizontal indentation along its length, the indentation being positioned to accept the edge of a shoe insole which is repositioned in a shoe after the insert has been placed in the shoe.

12. The orthotic shoe insert of claim 1, constructed of a closed cell foam.

13. The orthotic shoe insert of claim 12, wherein the closed cell foam is polyurethane.

* * * * *